United States Patent [19]

Komatsu et al.

[11] Patent Number: 4,572,651

[45] Date of Patent: Feb. 25, 1986

[54] METHOD FOR DEVELOPING AN ELECTROSTATIC LATENT IMAGE IN AN ELECTROPHOTOGRAPHIC RECORDING APPARATUS

[75] Inventors: Isamu Komatsu, Takahagi; Masayasu Anzai; Nobuyoshi Hoshi, both of Hitachi, all of Japan

[73] Assignee: Hitachi, Ltd., Tokyo, Japan

[21] Appl. No.: 378,173

[22] Filed: May 14, 1982

[30] Foreign Application Priority Data

May 15, 1981 [JP] Japan ..... 56-72181

[51] Int. Cl.[4] ..... G03G 15/01; G03G 13/01

[52] U.S. Cl. ..... 355/4; 355/3 DD; 430/45

[58] Field of Search ..... 355/4, 3 DD, 10, 77; 430/45, 100, 122, 42; 118/645; 346/157

[56] References Cited

U.S. PATENT DOCUMENTS 4,308,821 1/1982 Matsumoto et al. ..... 355/4 X 4,416,533 11/1983 Tokunaga et al. ..... 355/3 DD X

FOREIGN PATENT DOCUMENTS 0083069 6/1980 Japan ..... 355/4

*Primary Examiner*—A. T. Grimley

*Assistant Examiner*—J. Pendegrass

*Attorney, Agent, or Firm*—Antonelli, Terry & Wands

[57] ABSTRACT

In an electrophotographic recording method in which electric charge is uniformly applied to the surface of a photoconductive drum, the drum surface is then exposed to a first information light beam to form a first negative latent image, the first negative latent image is developed with a first two-component developer, the drum surface is further exposed to a second information light beam to form a second negative latent image, and the second negative latent image is developed with a second two-component developer to produce a two-color toner image, the toner content in the second two-component developer is larger than that in the first two-component developer.

5 Claims, 3 Drawing Figures

Figure 1:
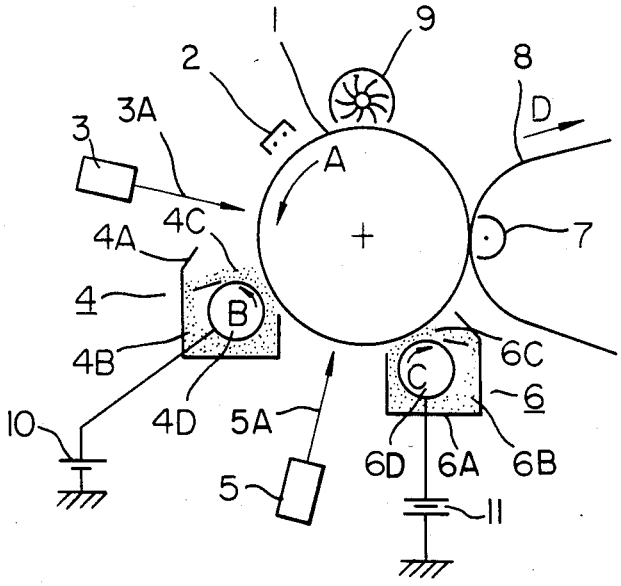

METHOD FOR DEVELOPING AN ELECTROSTATIC LATENT IMAGE IN AN ELECTROPHOTOGRAPHIC RECORDING APPARATUS

This invention relates to an electrophotographic recording method and, more particularly, to an electrophotographic recording method useful for producing a two-color image by toners of two different colors by forming a first electrostatic latent image on the surface of a photoconductive drum and, developing the image with a toner of first color, forming a second electrostatic latent image, and developing the second image with a toner of second color different from the first color.

In, for example, Japanese Pre-examination Publication No. 83069/80 corresponding to U.S. patent application Ser. No. 93,034 filed Nov. 9, 1979, a recording apparatus for production of a two-color image is proposed wherein the surface of a rotating photoconductive drum is uniformly charged, and exposed by a first exposure unit to form a first electrostatic latent image. The first electrostatic latent image is processed for reversal development with a first two-component developer containing a toner of a first color through a first magnetic brush, with the photoconductive drum surface then being exposed by a second exposure unit to form a second electrostatic latent image. The second electrostatic latent image is processed for reversal development with a second two-component developer containing a toner of a second color through a second magnetic brush. Since, in such an electrophotographic recording apparatus, the second electrostatic latent image is formed on the surface of the photoconductive drum and developed by the second magnetic brush when a toner image of the first color is not strongly fixed to the surface of the photoconductive drum, but held thereon substantially by electrostatic force, the toner image of the first color may be brushed by the second magnetic brush. Through this brushing, the toner image of the first color is disturbed, or the toner of the first color is scratched off by the second magnetic brush and as a result, a part of the first toner may be transferred to the second magnetic brush and/or to the container of the second two-component developer and mixed therewith. After long-term use of the electrophotographic recording apparatus, the amount of the first color toner mixed with the second two-component developer increases and, consequently, the toner image produced by the second developer contaminated by color mixture, thus impairing the production of a clear two-color toner image.

Accordingly, an object of this invention is to provide an electrophotographic recording method capable of producing a clear two-color toner image over long-term use.

According to this invention, the ratio of toner to carrier in a first two-component developer used for a first developing unit is smaller than the toner to carrier ratio of a second two-component developer used for a second developing unit so that the amount of electric charge on the toner of the first two-component developer is larger than the amount of electric charge on the toner of the second two-component developer to provide strong adhesion of a first toner image to the surface of a photoconductive drum and weak adhesion of the second toner to the carrier of the second two-component developer, thereby, upon development, preventing the first color toner from being peeled off from the surface of the photoconductive drum and mixing with the second two-component developer.

In the first two-component developer, relatively small-sized particles of the first color toner adhere to the outer peripheral surface of the carrier by electrostatic force and the toner-to-carrier ratio is small so that the amount of electric charge on the toner particle becomes relatively large and adhesion of the toner particle to the carrier becomes stronger. Accordingly, upon development of an electrostatic latent image, occurrence of a fog phenomenon is suppressed to ensure the production of a clear toner image. Additionally, because of the large amount of electric charge on this toner, the toner once adhered to the surface of the photoconductive drum is strongly adhered to the surface of the photoconductive drum and hardly separated from the photoconductive drum surface. On the other hand, in the second two-component developer, relatively small-sized particles of the second color toner also adhere to the outer peripheral surface of the carrier by electrostatic force. When the toner-to-carrier ratio of the second two-component developer is larger than that for the first two-component developer, the toner densely adheres to the outer peripheral surface of the carrier in the second two-component developer and, consequently, electrostatic force exerted by the carrier of the second developer upon the first color toner adhered to the photoconductive drum surface is small. In addition, with a large toner-to-carrier ratio, the second two-component developer has a large electrical resistance so that the decay of electric charge on the first electrostatic latent image through the second two-component developer is small and hence electrostatic force for holding the first color toner adhered to the photoconductive drum surface will not be reduced. In this manner, upon development of the second electrostatic latent image with the second two-component developer, the separation of the first color toner from the photoconductive drum surface can be suppressed and the mixing of the first color toner into the second two-component developer can be reduced.

Figure 2A:
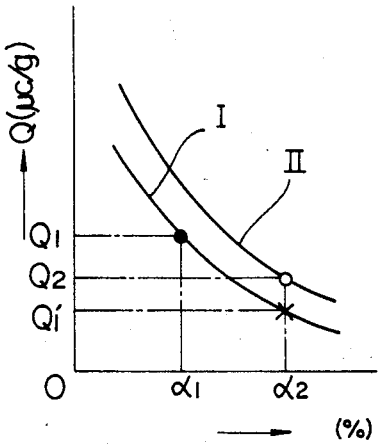
Figure 2B:
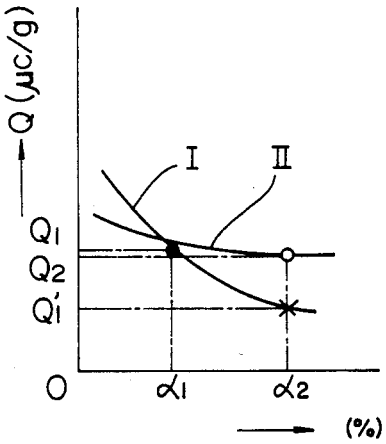

The present invention will be well understood from the following description of preferred embodiments of the present invention in conjunction with the accompanying drawings in which:

FIG. 1 is a schematic diagram of an electrophotographic recording apparatus to which the method of the present invention is applied; and FIGS. 2A and 2B are graphical illustrations of a relationship between a toner-to-carrier ratio $\alpha$ in each of the first and second two-component developers and electric charge Q in a toner used in the present invention.

In an electrophotographic recording apparatus schematically shown in FIG. 1, a photoconductive drum 1 is rotated by a drive mechanism (not shown) in a direction of arrow A. The surface of the photoconductive drum 1 being first uniformly charged by a corona charger 2 according to the known electrophotographic process. Disposed downstream of the corona charger 2 in the direction of rotation of the photoconductive drum 1 is a first exposure unit 3 for exposing the surface of the photoconductive drum 1 to a first information light beam 3A for forming a first electrostatic latent image to be developed with a toner of a first color of, for example, black. This first electrostatic latent image is a negative latent image in which electric charge is cancelled out at portions to be adhered with the toner. A first developing unit 4, adapted for reversal development of the first electrostatic latent image, comprises a developer container 4A containing a first two-component developer 4B, and a developing roll 4D which attracts the first two-component developer 4B to create a first magnetic brush 4C of the developer, with the developing roller 4D rotating in a direction of the arrow B. Disposed downstream of the first developing unit 4 is a second exposure unit 5 by means of which the surface of the photoconductive drum 1 is exposed to a second information light beam 5A for forming a second electrostatic latent image to be developed with a toner of a second color of, for example, red. The second electrostatic latent image is also a negative latent image. A second developing unit 6, adapted for reversal development of the second electrostatic latent image, comprises a developer container 6A containing a second two-component developer 6B and a developing roll 6D which attracts the two-component developer 6B to create a second magnetic brush 6C and, with the second developing roller 6D rotating in a direction of the arrow C. Disposed downstream of the developing unit 6 is a transfer unit 7 at which a recording paper web 8, traveling in a direction of the arrow D, comes into contact with the surface of the photoconductive drum 1 to ensure that the composite toner image is electrostatically transferred from the surface of the photoconductive drum 1 to the surface of the recording paper web 8. A cleaner 9 is adapted to remove residual toner remaining on the surface of the photoconductive drum 1.

In a preferred embodiment, the present invention is applied to the electrophotographic recording apparatus of the above construction in such a manner that the toner-to-carrier ratio of the second two-component developer 6B is larger than the toner-to-carrier ratio of the first two-component developer 4B. More specifically, the carrier of the first developer 4B is covered at about 20–60% of its total surface area by a layer of the first color toner, while the carrier of the second developer 6B is covered at about 30–300% for practical use and preferably 40–200% of its total surface area by a layer of the second color toner. In this connection surface covering percentages more than 100% such as 200% or 300% indicate that the carrier is covered at its total surface by two or three layers of particles of the toner. If the ratio of the second color toner is excessively small, the amount of the first color toner mixed into the second developer increases, whereas, if the ratio of the second color toner is excessively large, the fog phenomenon may occur due to the second color toner and contamination of the apparatus due to scattering of the second color.

The scratching off of the first color toner and the scattering of the second color toner are greatly affected by the brushing force of the second magnetic brush 6C exerted upon the surface of the photoconductive drum 1. In this embodiment, the surface of the photoconductive drum 1 and the second magnetic brush 6C are rotated in the same direction to reduce the relative movement between them, thereby suppressing scratching-off of the first color toner and scattering of the second color toner. Due to the fact that the toner-to-carrier ratio is larger in the second developer 6B than in the first developer 4B, the second color toner is easily separated from the carrier and attracted to the second electrostatic latent image formed on the photoconductive drum 1. Accordingly, when the distance between the second developing roll 6D and the photoconductive drum 1 is larger than the distance of the first developing roll 4D therefrom to ensure that the brushing of the photoconductive drum surface by the second magnetic brush 6C is weakened, it is possible to suppress scratching-off of the first color toner, scattering of the second color toner or adhesion of the second color toner to the first color toner on the photoconductive drum. The second magnetic brush 6C may be disposed near the surface of the photoconductive drum, without making contact thereto. Specifically, when the first and second magnetic brushes 4C and 6C are at the same brush height, by adjusting the gap of a doctor roll (not shown) for regulating the magnetic brush height at 4 mm, good results are obtained with the gap between the first developing roll 4D and the surface of the photoconductive drum 1 being 4 mm, the gap between the second developing roll 6D and the photoconductive drum 1 being 4.5 to 5.2 mm, and with the rotational peripheral speed of the developing roll 6D being 0.5 to 3 times as large as that of the photoconductive drum 1.

As shown in FIG. 2A, the toner ratio $\alpha$ and toner electric charge Q of the first developer 4B change along curve I and those of the second developer 6B change along curve II. In accordance with this invention, the toner ratio $\alpha$ of the first developer 4B is set to $\alpha_1$, and that of the second developer 6B is set to $\alpha_2$. For example, for the first developer 4B, the toner ratio, that is, the percentage in weight of the toner mixed in the developer, is $\alpha_1 \approx 2\%$ in weight and the electric charge is $Q_1 \approx 30$ to 50 $\mu C/g$, and for the second developer 6B, the toner ratio $\alpha_2 \approx 2.5$ to 3.5% in weight and the electric charge $Q_2 \approx 30$ $\mu C/g$. As shown in FIGS. 2A, 2B when the toner ratio of the first developer 4B is set at the same value as that of the toner ratio $\alpha_2$ of the second developer 6B, the toner of the first developer 4B has an electric charge $Q_1' \approx 10$ to 20 $\mu C/g$ which is less than the electric charge $Q_2$ of the second developer 6B by about 10 $\mu C/g$ or more.

As shown in FIG. 2B, the toner electric charge Q of the second developer 6B changes less sharply than that of the first developer with change of the toner ratio $\alpha$, but characteristics in the range of actual use are similar to those of the two-component developers shown in FIG. 2A.

It will readily be appreciated that the operation and effect described hereinbefore can be accomplished by using these two-component developers 4B and 6B in the first and second developing units 4 and 6. Also, the first and second developing units 4 and 6 using these two-component developers 4B and 6B are effective to reduce the amount of the first color toner mixed into the second developer 6B as will be described below. Assuming that the first color toner which adheres to the surface of the photoconductive drum 1 is brushed by the second magnetic brush 6C and the first color toner is peeled off and mixed into the second developer 6B, the toner ratio $\alpha_2$ of the second developer 6B remains substantially unchanged since the amount of the first color toner mixed into the second developer 6B is small. In this case, the electric charge Q on the mixed first color toner is $\alpha_1'$ for the toner ratio $\alpha_2$ so that the electric charge on the first color toner is smaller than that on the second color toner within the second developer 6B. The toner having the smaller electric charge Q develops a weak adhesion to the carrier so that it is liable to adhere to the second electrostatic latent image formed on the photoconductive drum 1. Consequently, the first color toner is more readily adhered to the photoconductive drum 1 than the second color toner and thus consumed in a short period. Therefore, the first color toner will not accumulate in the second developer 6B and thus, the amount of the first color toner mixed into the second developer can advantageously be suppressed.

In the electrophotographic recording method of the invention, when a DC bias voltage of the same polarity as that of the latent charge on the photoconductive drum 1 is applied to the first magnetic brush 4B by the DC voltage means 10, a sufficient amount of the first color toner strongly adheres to the first electrostatic latent image, thereby preventing the second color toner from adhering to the first color toner image upon development of the second electrostatic latent image. When a DC bias voltage of the same polarity as that of the latent charge on the photoconductive drum 1 is applied to the second magnetic brush 6C by the DC voltage means 11, the developing characteristic can be so improved that brushing of the surface of the photoconductive drum 1 by the magnetic brush 6C may be weakened or the peripheral speed in rotation of the magnetic brush 6C may be reduced, thus making it possible to suppress peeling-off and mixing of the first color toner and scattering of the second color toner.

Although the invention has been described by way of recording of the two-color toner image, a toner image of more than two colors may easily be obtained by increasing the steps of recording.

As described above, according to this invention, it is possible to suppress a peeling-off of the first color toner adhered to the first electrostatic latent image on the photoconductive drum and mixing thereof into the second two-component developer upon development by the second developing unit, by making the toner-to-carrier ratio of the first binary developer used for the first developing unit smaller than that of the second two-component developer used for the second developing unit, thereby producing a clear toner image free from cross-contamination over a long-term use.

We claim:

1. A method for electrophotographically recording a color image by using an electrophotographic recording apparatus comprising a rotatable photoconductive drum, the method comprising the steps of uniformly charging the surface of the photoconductive drum, exposing the charged photoconductive drum in a first exposure means to form a first electrostatic latent image, providing a first developing means containing a first two-component developer for reversal development of the first electrostatic latent image, disposing a second exposure means downstream of the first developing means in the rotational direction of the photoconductive drum, providing a second developing means containing a second two-component developer for reversal development of the second electrostatic latent image, and providing a toner-to-carrier ratio of said first two-component developer which is less than a ratio of said second two-component developer.

2. A method for electrophotographically recording a color image by using an electrophotographic recording apparatus comprising a rotatable photoconductive drum, the method comprising the steps of uniformaly charging the surface of the photoconductive drum, exposing the charged photoconductive drum in a first exposure means to form a first electrostatic latent image, providing a first developing means containing a first two-component developer for reversal development of the first electrostatic latent image, disposing a second exposure means downstream of the first developing means in the rotational direction of the photoconductive drum, providing a second developing means containing a second two-component developer for reversal development of the second electrostatic latent image, providing a toner-to-carrier ratio of said first two-component developer equal to the toner-ratio of the second two-component developer, and providing a smaller charge on the toner of said first developer than a charge on the toner of said second developer.

3. A method according to claim 1, further comprising the steps of creating a magnetic brush in each of said first and second developing means for each of said first and second two-component developers for brushing the surface of said photoconductive drum, and rotating the magnetic brushes of said second developing means such that said magnetic brush of said second developing means and said photoconductive drum move in the same direction at portions thereof facing each other.

4. A method according to claim 3, further comprising the step of urging said photoconductive drum by the magnetic brush of said second developing means by a force weaker than a force of the magnetic brush of said first developing means.

5. A method according to one of claims 3 or 4, further comprising the step of applying a bias voltage of the same polarity as a bias voltage of an electric charge on the surface of said photoconductive drum to the magnetic brush of said second developing means.

* * * * *